US008683973B2

(12) United States Patent
Raasch

(10) Patent No.: US 8,683,973 B2
(45) Date of Patent: Apr. 1, 2014

(54) INTAKE RUNNER FOR AN INTERNAL COMBUSTION ENGINE

(75) Inventor: Jason J. Raasch, Cedarburg, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 613 days.

(21) Appl. No.: 12/902,693

(22) Filed: Oct. 12, 2010

(65) Prior Publication Data

US 2012/0085312 A1 Apr. 12, 2012

(51) Int. Cl.
*F02F 1/42* (2006.01)

(52) U.S. Cl.
USPC ..... 123/193.5; 123/184.21; 123/188.1; 123/306; 123/432; 123/657

(58) Field of Classification Search
USPC ..... 123/193.5, 306, 308, 432, 657, 184.21, 123/188.1, 184.27, 193.1; 29/888.01; 60/289, 307
See application file for complete search history.

(56) References Cited

U.S. PATENT DOCUMENTS

| | | | | |
|---|---|---|---|---|
| 4,207,660 | A | 6/1980 | Rao et al. | |
| 4,300,494 | A | 11/1981 | Graiff et al. | |
| 4,428,334 | A | 1/1984 | Klomp | |
| 4,430,856 | A | 2/1984 | Niedert | |
| 4,676,064 | A | 6/1987 | Narita et al. | |
| 5,593,745 | A | 1/1997 | Haselkorn et al. | |
| 5,603,299 | A | 2/1997 | Yuzuriha et al. | |
| 5,842,342 | A | 12/1998 | Strasser et al. | |
| 6,006,721 | A | 12/1999 | Shannon et al. | |
| 6,026,774 | A | 2/2000 | Kajihara et al. | |
| 6,161,513 | A | 12/2000 | Lohr et al. | |
| 6,460,502 | B2 | 10/2002 | Gracyalny | |
| 6,742,488 | B2 * | 6/2004 | Bonde et al. | 123/184.21 |
| 6,817,334 | B2 | 11/2004 | Gould | |
| 7,370,620 | B1 | 5/2008 | Nino et al. | |
| 7,424,878 | B2 | 9/2008 | Sugiyama | |
| 2004/0221830 | A1 | 11/2004 | Kuehner et al. | |
| 2006/0254551 | A1 | 11/2006 | Fields | |
| 2008/0314352 | A1 | 12/2008 | Brosseau et al. | |

* cited by examiner

*Primary Examiner* — Lindsay Loo
*Assistant Examiner* — Ruben Picon-Feliciano
(74) *Attorney, Agent, or Firm* — Foley & Lardner LLP

(57) ABSTRACT

An internal combustion engine, which includes a cylinder block, a cylinder head fastened to the cylinder block, an aperture formed in a side of the cylinder head, and a conduit assembly, such as an intake runner assembly or an exhaust conduit assembly. A combustion chamber is formed by the cylinder block and the cylinder head. The intake runner assembly is received within the aperture and configured to communicate air to the combustion chamber. The intake runner assembly includes a first piece and a second piece. The first piece has a first channel that includes a bend. The second piece has a second channel that includes another bend mirroring the bend of the first channel. The first piece is coupled to the second piece such that the first and second channels together form a flow path through the intake runner assembly, and the bends of the first and second channels together form a smooth turn in the flow path.

18 Claims, 6 Drawing Sheets

INTAKE RUNNER FOR AN INTERNAL COMBUSTION ENGINE

BACKGROUND

The present application relates generally to the field of internal combustion engines. More specifically, the present application relates to air passages within internal combustion engines.

Typically an internal combustion engine includes an intake runner extending between the throttle and the combustion chamber of the engine. For example, the intake runner may be a pipe extending from a throttle plate of a carburetor to an intake valve of the combustion chamber. For overhead valve type engines, the intake runner extends through the cylinder head. However in other engine configurations, such as L-head engines, the intake runner may extend through the engine block.

For some overhead valve engines, the intake runner has a simple geometry and is integrally formed during casting of a single-piece cylinder head. In such engines, the intake runner extends inward from a side of the cylinder head, in a generally straight path, where the path then opens to the combustion chamber. The straight path geometry may be relatively simple to manufacture, but may also provide significant drag to air passing through the intake runner as the air turns to pass into the cylinder. Such drag would reduce the flow rate of the air, decreasing the efficiency of the engine.

In other overhead valve engines, the intake runner has a complex design intended to reduce drag. Expendable cores of salt or sand may be used during casting to form the complex design. In such engines, the complex design may improve engine efficiency, however use of the expendable cores adds complexity to the manufacturing process and consumes additional materials and resources.

SUMMARY

One embodiment of the invention relates to an internal combustion engine, which includes a cylinder block, a cylinder head fastened to the cylinder block, an aperture formed in a side of the cylinder head, and a conduit assembly, such as an intake runner assembly or an exhaust conduit assembly. A combustion chamber is formed by the cylinder block and the cylinder head. The intake runner assembly is received within the aperture and configured to communicate air to the combustion chamber. The intake runner assembly includes a first piece and a second piece. The first piece has a first channel that includes a bend. The second piece has a second channel that includes another bend mirroring the bend of the first channel. The first piece is coupled to the second piece such that the first and second channels together form a flow path through the intake runner assembly, and the bends of the first and second channels together form a smooth turn in the flow path.

Another embodiment of the invention relates to an internal combustion engine, which includes a cylinder block, a cylinder head fastened to the cylinder block, an aperture, and an intake runner assembly. The aperture is cylindrical and extends inward from a side of at least one of the cylinder head and the cylinder block. The intake runner assembly extends within the aperture, and includes an exterior contoured to fit the aperture. Further, the intake runner assembly includes a first piece and a second piece. The first piece has a first channel extending along the first piece. The second piece is adjacent to the first piece, and has a second channel extending along the second piece. The first and second channels of the first and second pieces form a flow path through the intake runner assembly.

Yet another embodiment of the invention relates to a method of manufacturing an internal combustion engine, which includes an assembling step and a fastening step. The assembling step includes assembling an intake runner assembly, at least in part, by coupling a first piece with a second piece. The first piece has a first channel and the second piece has a second channel, and the first and second pieces are coupled such that the first and second channels form a flow path through the intake runner assembly. The fastening step includes fastening the intake runner assembly within a cylinder head to form an arcuate flow path through the cylinder head.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
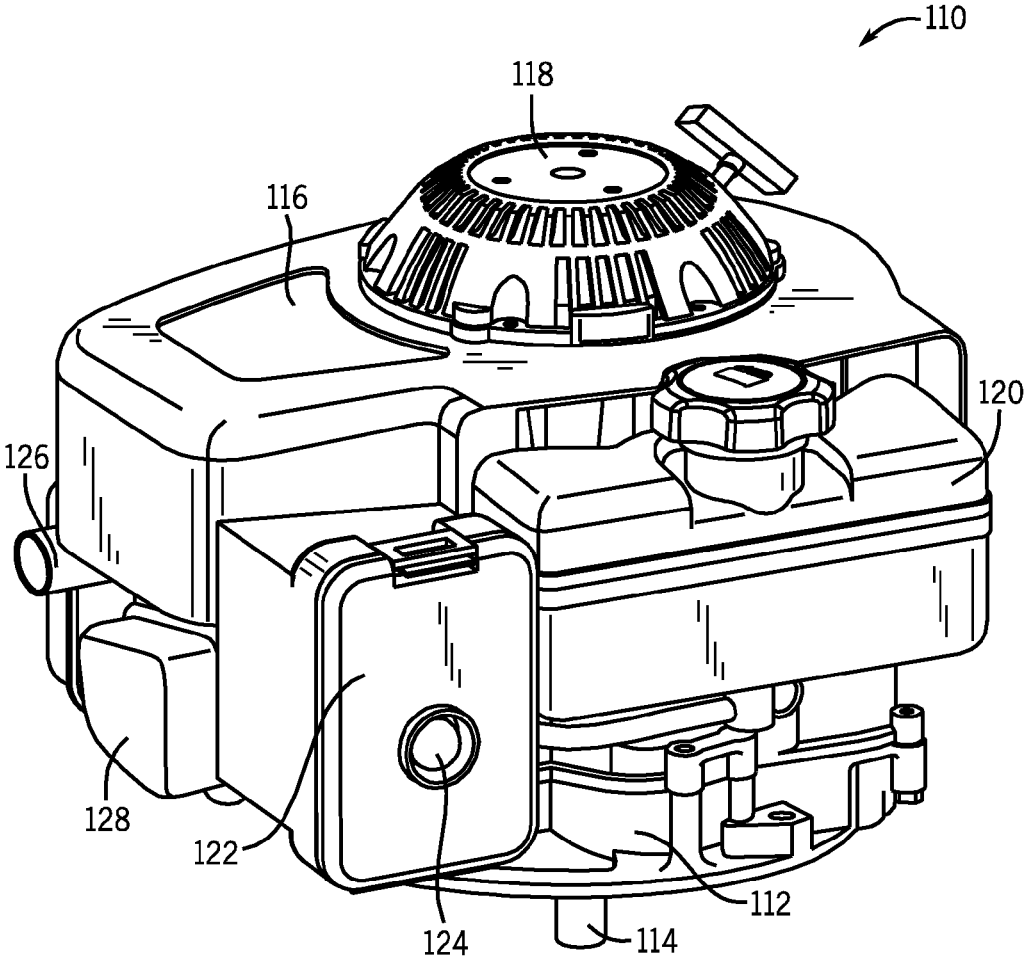
FIG. 1 is a perspective view of an internal combustion engine according to an exemplary embodiment of the invention.
Figure 9:
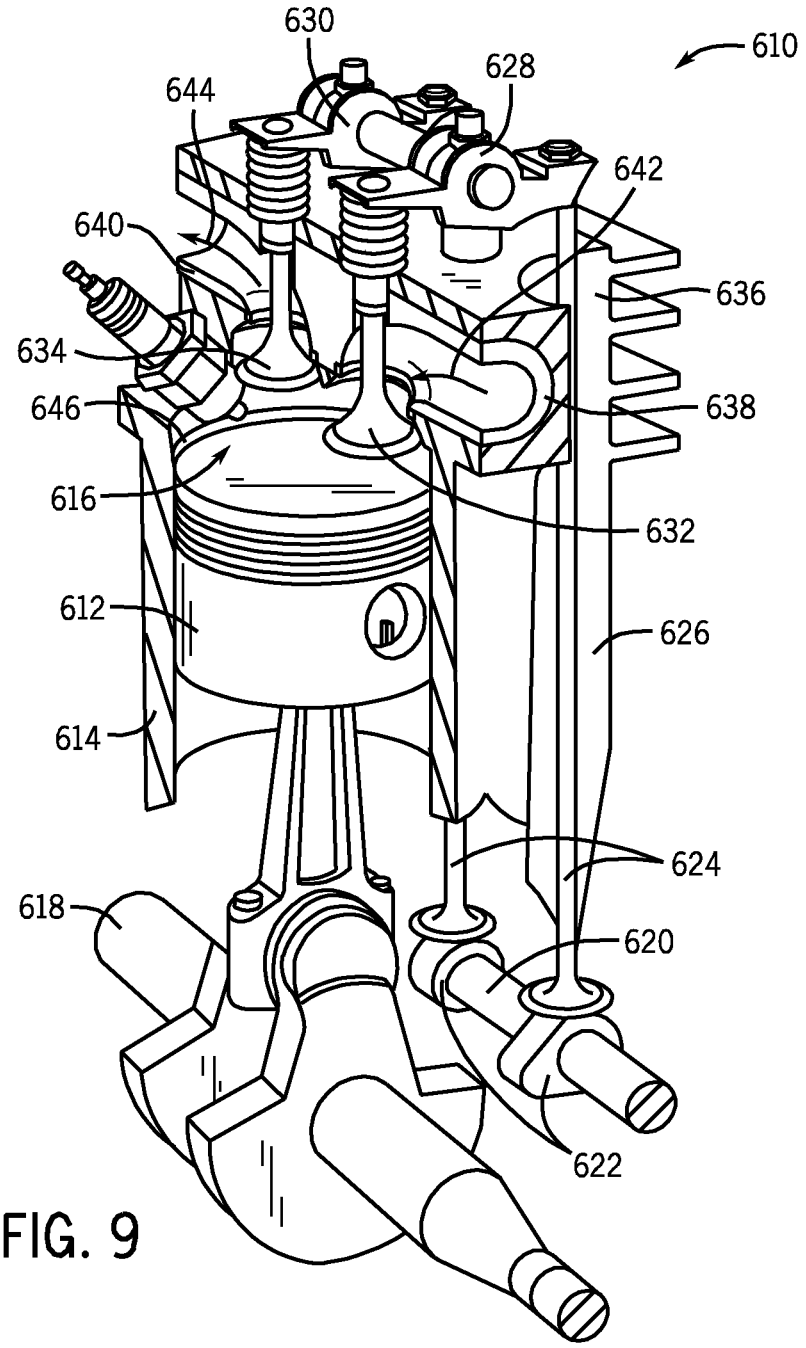
FIG. 9 is a perspective view of components of an internal combustion engine according to an exemplary embodiment of the invention.

Referring to FIG. 1, an internal combustion engine 110 includes an engine block 112 supporting components of the engine 110, such as a power take-off 114 of a crankshaft (see also crankshaft 620 as shown in FIG. 9). In some embodiments, the engine 110 includes an engine cover 116, a recoil starter 118, a fuel tank 120, an air cleaner assembly 122, a priming button 124, an exhaust pipe 126, and a rocker cover 128. FIG. 1 shows the engine 110 as a vertically-shafted, single-cylinder, four-stroke cycle, gasoline-powered internal combustion engine, as may be used by a walk-behind rotary lawn mower. In other contemplated embodiments, diesel engines, multiple-cylinder engines, two-stroke cycle engines, or other internal combustion engine configurations may be used, and the engines may be used with a broad range of power equipment, vehicles, and the like.

Figure 2:
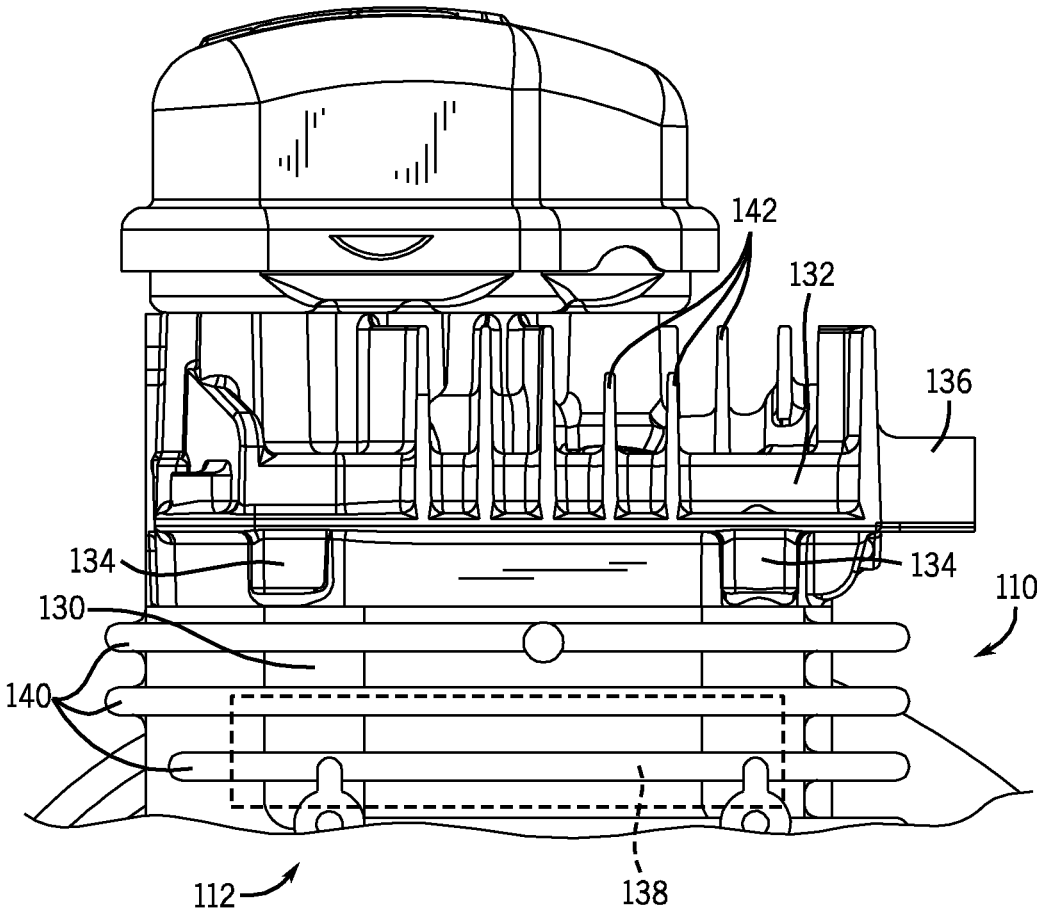
FIG. 2 is a side view of a cylinder head of an internal combustion engine according to an exemplary embodiment of the invention.

Referring to FIG. 2, the engine block 112 of the engine 110 includes a cylinder block 130. The cylinder block 130 may be integrally cast with the engine block 112 or separately formed and fastened to the engine block 112. A cylinder head 132 is fastened to the cylinder block 130, such that a combustion chamber (see, e.g., combustion chamber 616 as shown in FIG. 9) is formed between the cylinder head 132 and the cylinder block 130. Fins 140, 142 on the cylinder block 130 and cylinder head 132 are designed to facilitate heat transfer away from the combustion chamber. According to an exemplary embodiment, fastening structures 134 on the cylinder head 132 and/or cylinder block 130 allow for bolts or other fasteners to couple the cylinder head 132 and cylinder block 130. An additional fastening structure 136 extends from a side of the cylinder head 132 for attachment of a muffler.

Figure 3:
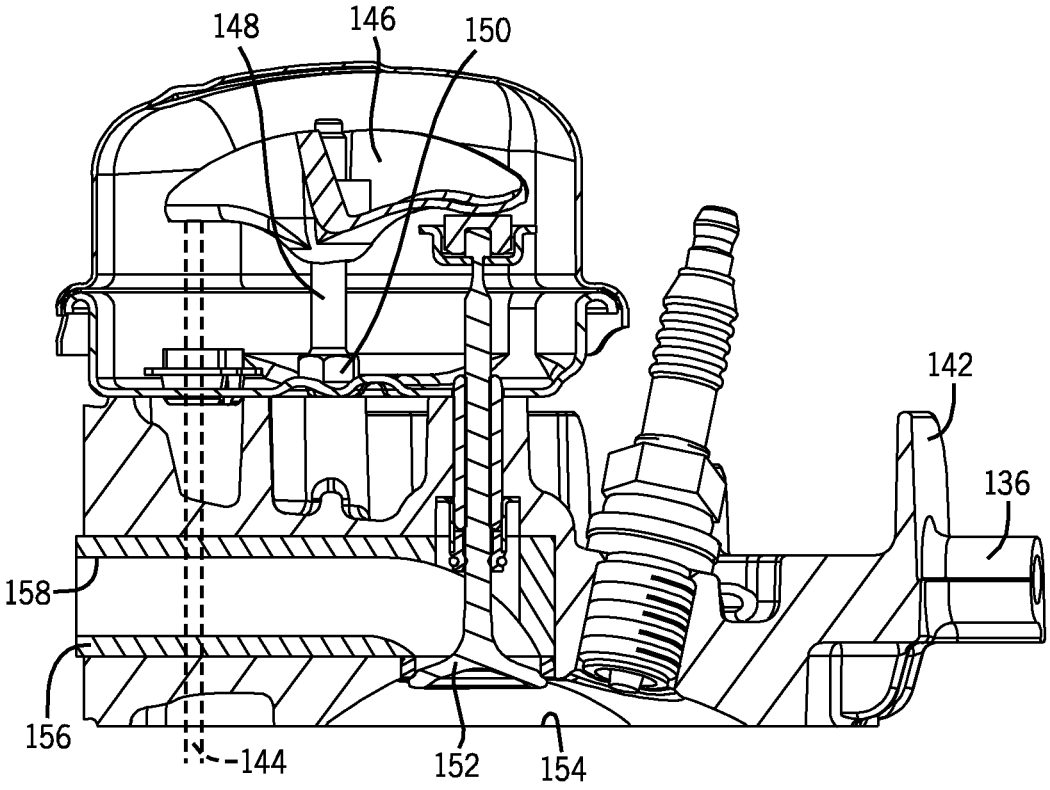
FIG. 3 is a sectional view of the cylinder head of FIG. 2.

Referring now to FIGS. 2-3, the engine 110 is arranged in an overhead valve configuration. Push rods 144 (FIG. 3) extend through the cylinder head 132 from a camshaft (see, e.g., camshaft 620 as shown in FIG. 9). The push rods 144 lift rockers 146 within the rocker cover 128 in response to movement of lobes (see, e.g., lobes 622 as shown in FIG. 9) on the camshaft. The rockers 146 pivot about fulcrums 148, which include threaded ends 150 that serve to fasten the rocker cover 128 to the cylinder head 132.

The rockers 146 push intake and exhaust valves 152 (e.g., poppet valves) that control the flow of gases through the combustion chamber as well as the intake and exhaust systems. The bottom of the cylinder head 132 forms the top of a combustion chamber 154. According to an exemplary embodiment, the cylinder block 130 includes an inner bore (see, e.g., bore 646 as shown in FIG. 9) through which a piston 138 (FIG. 2) translates in response to combustion processes occurring within the combustion chamber 154.

According to an exemplary embodiment, during the intake stroke of the engine 110 air and fuel pass through an intake runner 156 integrated with the cylinder head 132, to the intake valve 152, and then into the combustion chamber 154. The amount and direction of the flow are at least partially controlled by the geometry of the intake runner 156, and influence the volumetric efficiency of the engine 110.

According to an exemplary embodiment, the intake runner 156 is designed to facilitate an increased flow rate into the combustion chamber due to a flow path formed in the intake runner 156 designed to reduce drag losses. In some embodiments, the direction of the flow into the combustion chamber 154 is controlled by the intake runner 156, which is configured to evenly distribute the air and fuel such as by increasing the downdraft angle of the flow entering the combustion chamber 154.

According to an exemplary embodiment, the intake runner 156 is cast separately from the cylinder head 132 by way of an open/closed die casting process (e.g. aluminum die cast). In some embodiments, an aperture 158 is cut or drilled into the cylinder head 132 following casting. In other embodiments, the aperture 158 is formed in the cylinder head 132 during casting. The intake runner 156 extends into the aperture 158 and a pin, adhesive, pressure fitting, or other fastening systems hold the intake runner 156 within the aperture 158. In some embodiments, the intake runner 156 is formed from two or more pieces that are separately cast and coupled together when inserted in the cylinder head 132. The two or more pieces may be assembled and then cast with the cylinder head, putting the solid pieces into the die for the cylinder head and casting the cylinder head around the pieces.

Figure 4:
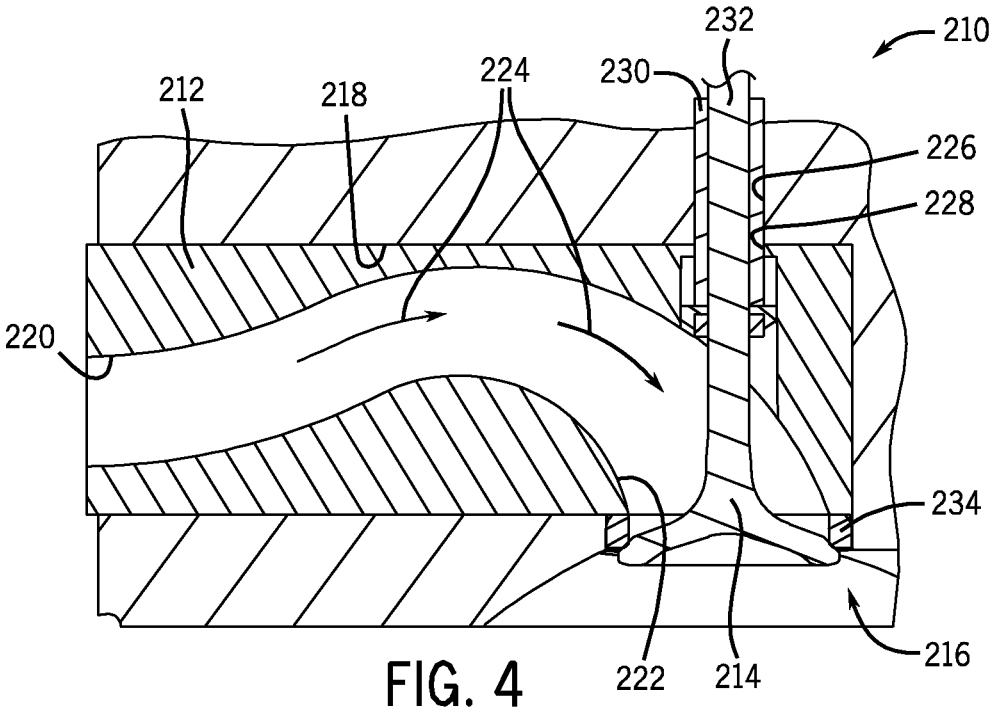
FIG. 4 is a sectional view of a cylinder head according to another exemplary embodiment of the invention.

Referring to FIG. 4, a cylinder head 210 includes an intake runner 212 and a valve 214. The bottom 216 of the cylinder head 210 is configured to form the top of a combustion chamber when the cylinder head 210 is fastened to an engine block (see, e.g., combustion chamber 616 as shown in FIG. 9). An aperture 218 is formed in the cylinder head 210, extending inward from a side of the cylinder head 210, and the intake runner 212 extends within the aperture 218. A flow path 224 extends through the intake runner 212 from an inlet 220 on one side of the intake runner 212 to an outlet 222 on another side of the intake runner 212. As such, the flow path 224 communicates air mixed with fuel through the cylinder head 210.

In some embodiments, an adhesive or sealant is positioned between the intake runner 212 and the aperture 218 of the cylinder head 210. The sealant or adhesive may serve to hold the intake runner 212 within the aperture 218 and to prevent air from flowing between the intake runner 212 and aperture 218, such as when the intake valve 214 is open and pressures in the combustion chamber are less than ambient pressure. A valve seat 234 additionally serves to prevent air from flowing between the intake runner 212 and aperture 218, such as when the intake valve 214 is closed and pressures in the combustion chamber are greater than ambient pressure. In other embodiments, other caps or solid seals are positioned between the intake runner 212 and the cylinder head 210, such as on the exterior side of the intake runner 212 and the cylinder head 210, or within the aperture 218 between the cylinder head 210 and the intake runner 212.

According to an exemplary embodiment, the cylinder head 210 includes an opening 226 extending from the top of the cylinder head 210 and intersecting the aperture 218. The intake runner 212 also includes an opening 228, which extends from the top of the intake runner 212 and intersects the flow path 224. The opening 226 of the cylinder head 210 is aligned with the opening 228 of the intake runner 212. In some embodiments, a valve guide 230 extends through each opening 226, 228, pinning the intake runner 212 within the aperture 218 of the cylinder head 210. One or both ends of the valve guide 230 may be flared to lock the value guide 230 within the openings 226, 228. In other embodiments, a dowel, pin, screw, or other item extends through the openings to pin the intake runner 212 within the aperture 218 of the cylinder head 210. According to an exemplary embodiment, a stem 232 of the valve 214 extends through the valve guide 230, allowing the valve 214 to open or close the flow path 224. When closed, the valve 214 is positioned within the valve seat 234 adjacent to the outlet 222 of the flow path 224.

According to an exemplary embodiment, the flow path 224 through the intake runner 212 is not completely straight. In some such embodiments, the flow path 224 is serpentine (e.g., S-shaped, winding) in design, which is intended to reduce drag losses associated sharp turns. In at least one embodiment, the flow path 224 curves upward before curving downward toward the combustion chamber. Smooth turns in the flow path 224 may reduce turbulence in the flow relative to a flow path having a sharp right-angle turn. According to an exemplary embodiment, the cross-section of the flow path 224 increases between the inlet 220 and the outlet 222. In some embodiments, the inlet 220 and outlet 222 of the flow path 224 are perpendicular to one another, and are formed on adjacent sides of the intake runner 212.

Figure 5:
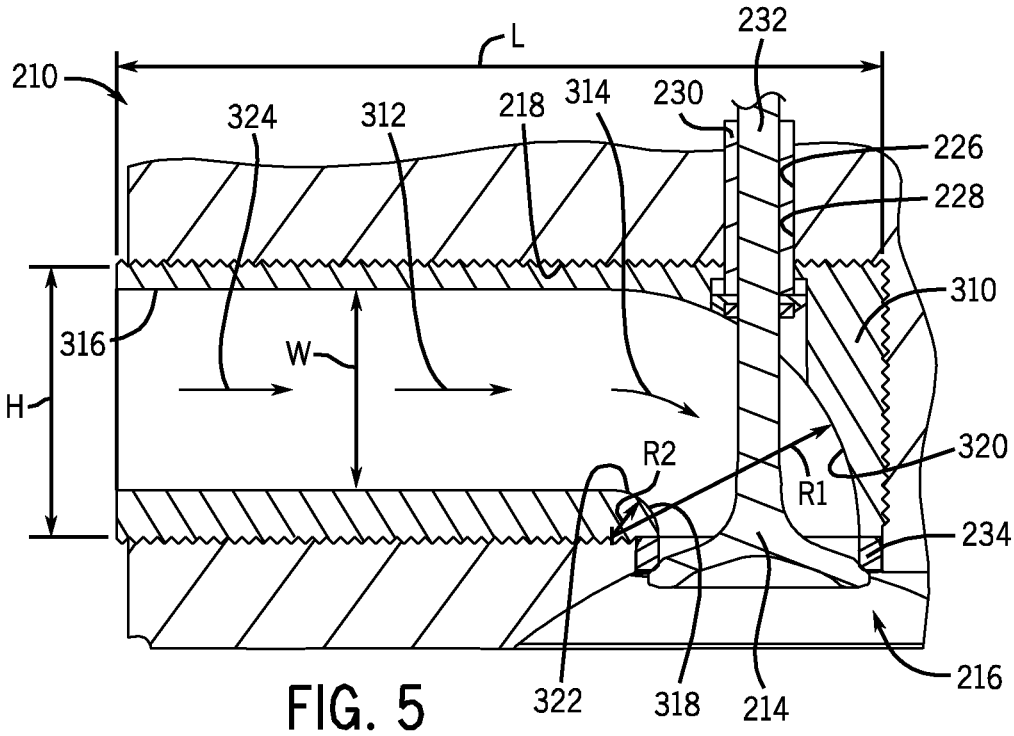
FIG. 5 is a sectional view of a cylinder head according to yet another exemplary embodiment of the invention.

Referring FIG. 5, an intake runner 310 is pinned within the aperture 218 of the cylinder head 210 by the valve guide 230 of the valve 214. The intake runner 310 has a flow path 312 that includes a smooth turn 314 between an inlet 316 and an outlet 318 of the flow path 312. The smooth turn 314 is round.

Figure 6:
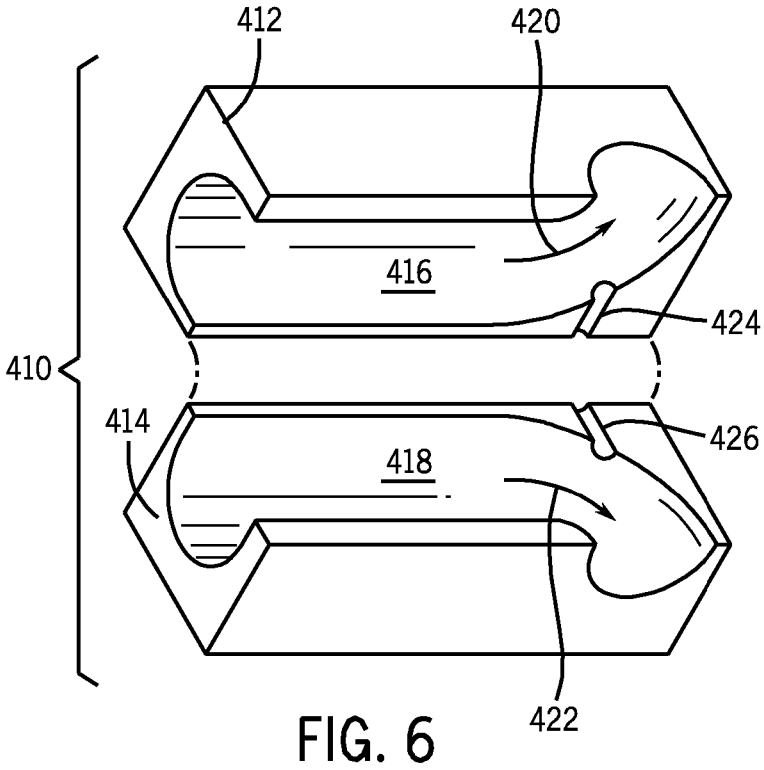
FIG. 6 is an exploded view of an intake runner assembly according to an exemplary embodiment of the invention.

The outermost side 320 and innermost side 322 of the flow path 312 around the smooth turn 314 substantially define circular arcs. In other embodiments, the smooth turn 314 does not have a constant radius, but instead has an increasing or decreasing radius (see generally channels 416, 418 as shown in FIG. 6).

According to an exemplary embodiment, the circular arcs defined by the innermost and outermost sides 320, 322 are less than or equal to ninety degrees (e.g., sixty degrees). In contrast to the flow path 224 of FIG. 4, the flow path 312 of FIG. 5 has a substantially constant cross-section from the inlet 316 to the outlet 318. In other contemplated embodiments, a flow path includes geometrical features in common with either or both of the flow paths 224, 314, and/or other features, such as an inlet that is wider than the outlet, or a flow path that narrows and then widens between the inlet and the outlet.

Still referring to FIG. 5, the length L of the intake runner 310 is greater than or equal to the height H, and the height H of the intake runner 310 is greater than the width W of the flow path 312. The radius of curvature $R_1$ of the outermost side 320 of the smooth turn 314 is less than or equal to the height H of the intake runner 310, such as less than the height H of the intake runner 310 minus a quarter-inch. The radius of curvature $R_2$ of the innermost side 322 of the smooth turn 314 is less than or equal to the height H of the intake runner 310 minus the width W of the flow path 312 in the sectional plane of FIG. 5. In other contemplated embodiments, the width of the flow path increases around the smooth turn such that the arcs defined by the innermost and outermost sides are not arcs of concentric circles.

In some embodiments, the intake runner 310 also includes a straight section 324 that extends from the inlet 316 to the smooth turn 314. According to an exemplary embodiment, the length of the straight section 324 is least the length L of the intake runner 310 minus the height H. In contemplated embodiments, the straight section 324 is not horizontal, but is instead upward or downward sloping. For example, in some embodiments a downward sloping straight section may improve the downdraft angle of the inlet runner.

Referring now to FIG. 6, two pieces 412, 414 of an intake runner assembly 410 are configured to be coupled to form a curved flow path. Each piece 412, 414 may be separately cast, such as by an open/closed die cast process. Channels 416, 418 are formed in the pieces 412, 414, where the channel 416 of the first piece 412 includes an arcuate bend 420 that is mirrored by an arcuate bend 422 in the channel 418 of the second piece 414. Grooves 424, 426 may be coupled to form an opening for a valve guide (see, e.g., valve guide 230 as shown in FIG. 5).

In some embodiments, the first and second pieces 412, 414 are mirror opposites of each other, having substantially the same weight, length, width, and height. The channels 416, 418 of each piece have approximately the same depth and cross-sectional curvature. In other contemplated embodiments, one of the pieces is larger than the other, and the other piece caps the larger piece. In still other contemplated embodiments, more than two pieces are used to form the runner intake.

Figure 7:
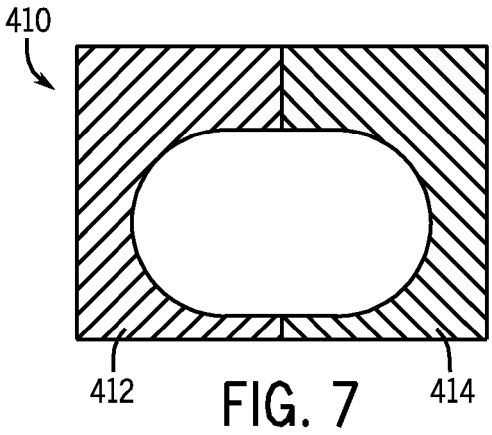
FIG. 7 is an end view of the intake runner assembly of FIG. 6 in another configuration.
Figure 8:
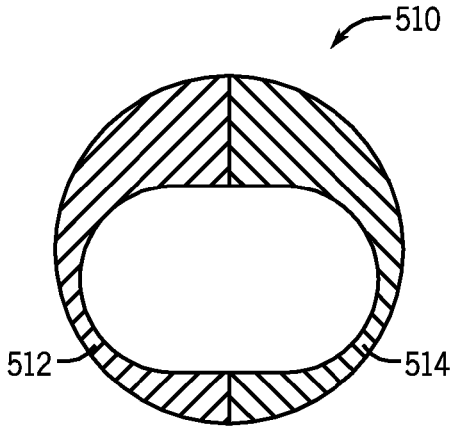
FIG. 8 is an end view of an intake runner assembly according to another exemplary embodiment of the invention.

Referring now to FIGS. 6-8, the two pieces 412, 414 of FIGS. 6-7 are assembled to have a rectangular (e.g., square) cross-sectional periphery (FIG. 6), while the two pieces 512, 514 of the intake runner assembly 510 of FIG. 8 are round (e.g., circular). The rectangular periphery of the intake runner assembly 410 helps to control alignment of the intake runner assembly 410 within a rectangular aperture (e.g., bore) of a cylinder head, which may facilitate alignment of an opening of the intake runner assembly 410 with a corresponding opening in the cylinder head for pinning the intake runner assembly 410 within the rectangular aperture.

A rectangular aperture may be formed during casting of the cylinder head, or may be formed by removing material from the cast cylinder head. Removing material to form the rectangular aperture may involve several cutting and/or drilling steps. However, use of a round cross-section for the intake runner assembly 510 allows for a corresponding cylindrical bore or aperture in a cylinder head, which may be drilled into the cast cylinder head in essentially one drilling step.

In some contemplated embodiments, the pieces of an intake runner assembly include a circular cross-section that includes a guide (e.g., longitudinal extension, protrusion) extending along the exterior of the intake runner assembly (not shown). Prior to drilling the bore or aperture, a relatively smaller hole is drilled into the cylinder head along the periphery of the location in which the bore will be drilled. The bore is then drilled into the cylinder head such that the bore intersects the smaller hole. When the intake runner assembly is inserted into the bore, the guide is inserted through the opening formed by the smaller hole.

In other contemplated embodiments, the intake runner may be integrated with an engine block, such as an engine block for an L-head engine or another engine configuration. In such embodiments, the aperture is formed (e.g., cut, drilled, cast) in the engine block, and a valve guide or other fastener (e.g., dowel, bolt, weld, pressure fit) holds the intake runner within the aperture in the engine block. In still other contemplated embodiments, an exhaust conduit is formed and used with a cylinder head or engine block in a manner similar to the use of the intake runners described herein. The engine may include both an intake runner and an exhaust conduit that are cast separately from the cylinder head and/or engine block to which the intake runner and exhaust conduit are integrated.

In at least one contemplated embodiment, an aperture includes a round cross-section that is threaded. In such embodiments, the aperture may be formed by drilling an aperture in a cast cylinder head, and then tapping the aperture. In such an embodiment, the sides of the aperture are substantially straight and the cross-section of the aperture is substantially constant. For example, in some embodiments the cross-section of the aperture is substantially constant, but has a slight taper (e.g., 2 to 5 degrees), which is intended to facilitate removal of an inserted die during an associated molding process. In other embodiments, the cross-section is substantially constant without a slight taper. A mating intake runner assembly includes a round cross-section that has been cast to include threads on the exterior surface. During assembly, the intake runner assembly is screwed into the cylinder head. The threads of the cylinder head and intake runner assembly are configured to properly position the intake runner assembly within the aperture, such that the outlet for the flow path is aligned with an intake valve of the engine.

Referring now to FIG. 9, an engine 610 includes a piston 612 that translates within a bore 646 of a cylinder 614 in response to combustion processes occurring in a combustion chamber 616. Translation of the piston 612 rotates a crankshaft 618, which in some embodiments is mechanically linked to a camshaft 620. Rotation of the camshaft 620 rotates lobes 622 that drive push rods 624 extending through the engine block 626 to rockers 628, 630. The rockers 628, 630 rotate to operate intake and exhaust valves 632, 634 in a cylinder head 636.

The engine 610 further includes an intake runner 638 and an exhaust conduit 640, both of which include a curved flow path 642, 644 designed to efficiently communicate gases. In some embodiments, the intake runner 638 and exhaust conduit 640 are integrally formed and are assembled by coupling two cast pieces (see generally pieces 412, 414 as shown in FIG. 6). The two pieces are essentially mirror opposites of one another, and only one of the pieces is shown in FIG. 9. During assembly of the engine 610, the two pieces are coupled and inserted through an aperture in the cylinder head 636 that extends entirely through the cylinder head 636. The aperture may have a round, rectangular, or otherwise shaped cross-section.

According to an exemplary embodiment, an intake runner is fastened to a cylinder head or engine block by way of a manufacturing process in which the intake runner is cast, assembled, and inserted into a mold for the cylinder head or engine block. When the cylinder head or engine block is cast, the material of the cylinder head or engine block solidifies around the intake runner assembly, fastening the intake runner assembly within the cylinder head or engine block. In some such embodiments, the intake runner assembly includes a textured surfaces, such as having ribs, ridges, etc. (see generally FIG. 5), to facilitate interlocking of the intake runner assembly and cylinder head or engine block during such a manufacturing process.

The construction and arrangements of the intake runner for an internal combustion engine, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. An internal combustion engine, comprising:
- a cylinder block;
- a cylinder head fastened to the cylinder block, wherein a combustion chamber is formed by the cylinder block and the cylinder head;
- an aperture formed in a side of the cylinder head; and
- a conduit assembly inserted within the aperture and configured to communicate air to the combustion chamber, comprising:
  - a first piece having a first channel, wherein the first channel comprises a bend; and
  - a second piece coupled to the first piece, wherein the second piece has a second channel, and wherein the second channel comprises another bend mirroring the bend of the first channel;
- wherein the first piece is coupled to the second piece such that the first and second channels together form a flow path through the conduit assembly, and the bends of the first and second channels together form a smooth turn in the flow path; and
- wherein the first and second pieces are substantially mirror opposites of each other.

2. The internal combustion engine of claim 1, wherein the cylinder head further comprises a first opening that intersects the aperture, wherein the conduit assembly further comprises a second opening that intersects the flow path, and wherein the first opening is aligned with the second opening.

3. The internal combustion engine of claim 2, further comprising:
- a valve having a valve stem; and
- a valve guide through which the valve stem extends, wherein the valve guide extends through the first opening and the second opening, pinning the conduit assembly within the aperture.

4. The internal combustion engine of claim 3, wherein an end of the valve guide is flared, locking the valve guide within the first opening and the second opening.

5. The internal combustion engine of claim 4, wherein the second opening is formed by a groove in the first piece aligned with a corresponding groove in the second piece.

6. The internal combustion engine of claim 5, wherein the aperture comprises substantially straight sides, and wherein the conduit assembly comprises an exterior contoured to match the substantially straight sides of the aperture.

7. The internal combustion engine of claim 6, wherein the aperture has a substantially constant cross-section.

8. The internal combustion engine of claim 7, wherein the substantially constant cross-section is circular.

9. The internal combustion engine of claim 7, wherein the substantially constant cross-section is rectangular.

10. An internal combustion engine, comprising:
- a cylinder block;
- a cylinder head fastened to the cylinder block;
- an aperture extending inward from a side of at least one of the cylinder head and the cylinder block, wherein the aperture is cylindrical; and
- an intake runner assembly inserted within the aperture, wherein the intake runner assembly comprises an exterior contoured to fit the aperture, the intake runner assembly further comprising:
  - a first piece having a first channel extending along the first piece; and
  - a second piece adjacent to the first piece, wherein the second piece has a second channel extending along the second piece;
- wherein the first and second channels of the first and second pieces form a flow path through the intake runner assembly;
- wherein the first channel comprises a bend, and wherein the second channel comprises another bend, and wherein the bends of the first and second channels together form a smooth turn in the flow path; and
- wherein the first and second pieces are substantially mirror opposites of each other.

11. The internal combustion engine of claim 10, wherein the flow path through the intake runner assembly comprises an inlet and an outlet, and wherein the inlet is perpendicular to the outlet.

12. The internal combustion engine of claim 11, wherein at least one of the cylinder head and the cylinder block further comprises a first opening that intersects the aperture, wherein the intake runner assembly further comprises a second opening that intersects the flow path, wherein the first and second openings are aligned, and the internal combustion engine further comprising:
- a valve having a valve stem; and
- a valve guide through which the valve stem extends, wherein the valve guide extends through the first and second openings, pinning the intake runner assembly within the aperture.

13. A method of manufacturing an internal combustion engine, comprising:

assembling an intake runner assembly at least in part by coupling a first piece with a second piece, wherein the first piece has a first channel and the second piece has a second channel, wherein the first and second pieces are coupled such that the first and second channels form a flow path through the intake runner assembly, and wherein the first and second pieces are substantially mirror opposites of each other; and fastening the intake runner assembly within a cylinder head to form an arcuate flow path through the cylinder head.

14. The method of claim 13, further comprising:

inserting a valve guide through overlapping openings in the cylinder head and the intake runner assembly.

15. The method of claim 14, further comprising:

flaring an end of the valve guide.

16. The method of claim 13, wherein the fastening step includes inserting the intake runner assembly within an aperture in the cylinder head, wherein the aperture is cylindrical, and wherein the aperture is at least partially formed by a drilling step.

17. The method of claim 13, further comprising:

casting the first piece and the second piece.

18. The method of claim 17, wherein the fastening step includes molding the cylinder head around the intake runner assembly.

* * * * *